US012228337B1

(12) United States Patent
Larson

(10) Patent No.: US 12,228,337 B1
(45) Date of Patent: Feb. 18, 2025

(54) FUEL GAS CONDITIONING UNITS FOR NATURAL GAS SYSTEMS

(71) Applicant: EOG Resources, Inc., Houston, TX (US)

(72) Inventor: Roy Curtis Larson, San Antonio, TX (US)

(73) Assignee: EOG Resources, Inc., Houston, TX (US)

( * ) Notice: Subject to any disclaimer, the term of this patent is extended or adjusted under 35 U.S.C. 154(b) by 0 days.

(21) Appl. No.: 18/436,588

(22) Filed: Feb. 8, 2024

Related U.S. Application Data

(60) Provisional application No. 63/444,496, filed on Feb. 9, 2023.

(51) Int. Cl.
*F25J 3/02* (2006.01)
*F25J 3/06* (2006.01)
*F25J 5/00* (2006.01)

(52) U.S. Cl.
CPC ..... *F25J 3/061* (2013.01); *F25J 3/0645* (2013.01); *F25J 3/0695* (2013.01); *F25J 5/005* (2013.01); *F25J 2215/60* (2013.01); *F25J 2215/62* (2013.01); *F25J 2240/40* (2013.01); *F25J 2245/02* (2013.01); *F25J 2270/02* (2013.01); *F25J 2270/08* (2013.01); *F25J 2290/44* (2013.01)

(58) Field of Classification Search
CPC ..... F25J 3/061; F25J 3/0645; F25J 3/0695; F25J 3/0238; F25J 3/0242; F25J 2215/60; F25J 2215/62; F25J 2245/02
See application file for complete search history.

(56) References Cited

U.S. PATENT DOCUMENTS

| | | | | |
|---|---|---|---|---|
| 4,936,887 | A * | 6/1990 | Waldo | C07C 7/005 62/929 |
| 7,104,766 | B2 | 9/2006 | Mascola | |
| 2007/0086906 | A1 | 4/2007 | Horley et al. | |
| 2008/0085185 | A1 | 4/2008 | Towsley et al. | |
| 2008/0202161 | A1* | 8/2008 | Vazquez-Esparragoza | C10L 3/10 62/620 |
| 2009/0214332 | A1 | 8/2009 | Towsley et al. | |
| 2011/0094264 | A1* | 4/2011 | Geers | F25J 3/067 62/618 |
| 2011/0132033 | A1* | 6/2011 | Prim | F25J 3/0242 62/618 |

(Continued)

*Primary Examiner* — Brian M King
(74) *Attorney, Agent, or Firm* — Conley Rose, P.C.

(57) ABSTRACT

A fuel gas conditioning unit includes a brazed aluminum heat exchanger including a plurality of parting sheets defining a plurality of separate flow channels positioned between the plurality of parting sheets, a plurality of fin sheets positioned in the plurality of flow channels, a feed inlet configured to receive a raw feed stream, a cooled feed outlet configured to discharge a cooled feed stream formed from the raw feed stream, a fuel outlet configured to discharge a finished fuel gas stream, and a liquids outlet configured to discharge a finished liquids stream, an expansion device coupled to the heat exchanger and configured to receive a cooled fuel stream from the heat exchanger and discharge an expanded fuel stream formed from the cooled fuel stream, and a feed separator where the heat exchanger is configured to form the finished fuel gas stream and the finished liquids stream.

30 Claims, 4 Drawing Sheets

(56) References Cited

U.S. PATENT DOCUMENTS

| | | | | |
|---|---|---|---|---|
| 2012/0125043 | A1* | 5/2012 | Cullinane | F25J 3/0233 62/620 |
| 2014/0033764 | A1* | 2/2014 | Higginbotham | F25J 3/067 62/639 |
| 2019/0226765 | A1* | 7/2019 | Xu | F28F 3/027 |
| 2020/0292230 | A1* | 9/2020 | Anguiano | F25J 3/0219 |
| 2020/0355427 | A1* | 11/2020 | Woodward | C10L 3/107 |
| 2021/0190420 | A1* | 6/2021 | Zhao | F25J 3/0242 |

* cited by examiner

FUEL GAS CONDITIONING UNITS FOR NATURAL GAS SYSTEMS

CROSS-REFERENCE TO RELATED APPLICATIONS

This application claims benefit of U.S. provisional patent application Ser. No. 63/444,496 filed Feb. 9, 2023, and entitled "Fuel Gas Conditioning Units for Natural Gas Systems," which is hereby incorporated herein by reference in its entirety for all purposes.

STATEMENT REGARDING FEDERALLY SPONSORED RESEARCH OR DEVELOPMENT

Not applicable.

BACKGROUND

Natural gas systems include a variety of systems utilized in connection with the extraction, transportation, and refinement of natural gas for different purposes. For example, compressor or compression "packages" or "units" are a type of natural gas system for transporting natural gas from an upstream production area where the gas is produced to a downstream location where the natural gas may be refined prior to being consumed by an end-user. Compressor packages typically include a compressor, such as a reciprocating compressor, that compresses and pressurizes the natural gas for transport. Compressor packages also include a driver for powering or driving the compressor of the compressor package, the driver often comprising an engine fueled by natural gas. Often, natural gas systems include one or more fuel gas conditioning units for producing lean fuel gas that may be supplied to the natural gas engine of a compressor package, to other components of the natural gas system which consume fuel gas, or to pipelines for sale and custody transfer.

BRIEF SUMMARY OF THE DISCLOSURE

An embodiment of a fuel gas conditioning unit comprises a brazed aluminum heat exchanger comprising a plurality of parting sheets defining a plurality of separate flow channels positioned between the plurality of parting sheets, a plurality of fin sheets positioned in the plurality of flow channels, a feed inlet configured to receive a raw feed stream, a cooled feed outlet configured to discharge a cooled feed stream formed from the raw feed stream, a fuel outlet configured to discharge a finished fuel gas stream, and a liquids outlet configured to discharge a finished liquids stream, an expansion device coupled to the heat exchanger and configured to receive a cooled fuel stream from the heat exchanger and discharge an expanded fuel stream formed from the cooled fuel stream, and a feed separator, comprising an inlet coupled to the expansion device and configured to receive the expanded fuel stream, an interior configured to separate the expanded fuel stream into a cooled fuel stream and a cooled liquids stream, a fuel outlet configured to discharge the cooled fuel stream such that the cooled fuel stream is received by a fuel inlet of the heat exchanger, and a cooled liquids outlet configured to discharge the cooled liquids stream such that the cooled liquids stream is received by a cooled liquids inlet of the heat exchanger, wherein the heat exchanger is configured to form the finished fuel gas stream from the cooled fuel stream received by the fuel inlet of the heat exchanger, and to form the finished liquids stream from the cooled liquids stream received by the cooled liquids inlet of the heat exchanger. In some embodiments, the fuel gas conditioning unit comprises a support structure upon which the heat exchanger, the expansion device, and the feed separator are physically supported. In some embodiments, the support structure comprises a road-transportable skid. In certain embodiments, the expansion device comprises a Joule-Thomson (JT) valve. In some embodiments, the pressure of the raw feed stream received by the heat exchanger is less than 1,000 pounds per square inch gauge (PSIG). In some embodiments, the pressure of the raw feed stream received by the heat exchanger is less than 800 PSIG. In certain embodiments, the pressure of the raw feed stream received by the heat exchanger is less than 600 PSIG. In some embodiments, the gross ideal heating value of the finished fuel gas stream discharged from the heat exchanger is equal to or greater than 1,150 British Thermal Units per foot cubed (BTU/ft$^3$). As used herein, the term "gross ideal heating value" refers to the heating value of a fluid (e.g., a fuel gas) where it is assumed that the fluid is free of inert compounds (e.g., N2, CO2, and H2O).

In some embodiments, the gross ideal heating value of the finished fuel gas stream discharged from the heat exchanger is equal to or greater than 1,100 BTU/ft$^3$. In certain embodiments, the gross ideal heating value of the finished fuel gas stream discharged from the heat exchanger is equal to or greater than 1,050 BTU/ft$^3$. In certain embodiments, the gross ideal heating value of the finished fuel gas stream discharged from the heat exchanger is equal to or greater than 1,000 BTU/ft$^3$. In some embodiments, the heat exchanger comprises a hot section defining a hot feed flowpath configured to receive the raw feed stream, a hot fuel flowpath configured to discharge the finished fuel gas stream, and a hot liquids flowpath configured to discharge the finished liquids stream, and wherein the hot section of the heat exchanger is configured to transfer heat in the hot section from the raw feed stream to both the finished fuel gas stream and the finished liquids stream, and a cold section separate from the hot section and defining a cold feed flowpath configured to discharge the cooled feed stream formed from the raw feed stream, a cold fuel flowpath configured to receive the cooled fuel stream, and a cold liquids flowpath configured to receive the cooled liquids stream, and wherein the cold section of the heat exchanger is configured to transfer heat in the cold section from the raw feed stream discharged from the hot section of the heat exchanger to both the finished fuel gas stream and the cooled liquids stream. In some embodiments, the fuel gas conditioning unit comprises a reboiler separator, comprising an inlet coupled to the cold section of the heat exchanger and configured to receive a reboil stream from a reboil outlet of the heat exchanger, wherein the reboil stream is formed in the cold section from the cooled liquids stream, an overhead outlet configured to discharge a recycle stream formed from the reboil stream in the reboiler separator, and a bottoms outlet configured to discharge a condensed liquids stream separated from the reboil stream in the reboiler separator such that the condensed liquids stream is received by a liquids inlet of the hot section of the heat exchanger, wherein the hot section is configured to form the finished liquids stream from the condensed liquids stream.

An embodiment of a fuel gas conditioning unit comprises a heat exchanger comprising a hot section defining a hot feed flowpath configured to receive a raw feed stream, a hot fuel flowpath configured to discharge a finished fuel gas stream, and a hot liquids flowpath configured to discharge a finished liquids stream, and wherein the hot section of the heat exchanger is configured to transfer heat in the hot section from the raw feed stream to both the finished fuel gas stream and the finished liquids stream, a cold section separate from the hot section and defining a cold feed flowpath configured to discharge a cooled feed stream formed from the raw feed stream, a cold fuel flowpath configured to receive a cooled fuel stream, and a cold liquids flowpath configured to receive a cooled liquids stream, and wherein the cold section of the heat exchanger is configured to transfer heat in the cold section from the raw feed stream discharged from the hot section of the heat exchanger to both the finished fuel gas stream and the cooled liquids stream, an expansion device coupled to the heat exchanger and configured to receive the cooled fuel stream from the heat exchanger and discharge an expanded fuel stream formed from the cooled fuel stream, a feed separator, comprising an inlet coupled to the expansion device and configured to receive the expanded fuel stream, a fuel outlet configured to discharge a cooled fuel stream that is separated from the expanded fuel stream in the feed separator such that the cooled fuel stream is received by a fuel inlet of the heat exchanger, and a cooled liquids outlet configured to discharge a cooled liquids stream separated from the expanded fuel stream in the feed separator such that the cooled liquids stream is received by a cooled liquids inlet of the heat exchanger. In some embodiments, the fuel gas conditioning unit comprises a reboiler separator, comprising an inlet coupled to the cold section of the heat exchanger and configured to receive a reboil stream from a reboil outlet of the heat exchanger, wherein the reboil stream is formed in the cold section from the cooled liquids stream, an overhead outlet configured to discharge a recycle stream formed from the reboil stream in the reboiler separator, and a bottoms outlet configured to discharge a condensed liquids stream separated from the reboil stream in the reboiler separator such that the condensed liquids stream is received by a liquids inlet of the hot section of the heat exchanger, wherein the hot section is configured to form the finished liquids stream from the condensed liquids stream. In certain embodiments, the fuel gas conditioning unit comprises a gas circulator coupled to the reboiler separator and configured to circulate the recycle stream from the reboiler separator such that the recycle stream is added to the cooled fuel stream discharged from the feed separator. In certain embodiments, the recycle stream comprises methane at a mole fraction of the recycle stream that is equal to or greater than 50%. In some embodiments, the recycle stream cumulatively comprises methane and ethane at a combined mole fraction of the recycle stream that is equal to or greater than 80%. In some embodiments, the heat exchanger comprises a plurality of parting sheets defining a plurality of separate flow channels positioned between the plurality of parting sheets, a plurality of fin sheets positioned in the plurality of flow channels.

An embodiment of a fuel gas conditioning unit comprises a brazed aluminum heat exchanger comprising a feed inlet configured to receive a raw feed stream having a pressure that is less than 1,000 PSIG, a cooled feed outlet configured to discharge a cooled feed stream formed from the raw feed stream, a fuel outlet configured to discharge a finished fuel gas stream, and a liquids outlet configured to discharge a finished liquids stream, an expansion device coupled to the heat exchanger and configured to receive a cooled fuel stream from the heat exchanger and discharge an expanded fuel stream formed from the cooled fuel stream, and a feed separator comprising an inlet coupled to the expansion device and configured to receive the expanded fuel stream, an interior configured to separate the expanded fuel stream into a cooled fuel stream and a cooled liquids stream, a fuel outlet configured to discharge the cooled fuel stream such that the cooled fuel stream is received by a fuel inlet of the heat exchanger, and a cooled liquids outlet configured to discharge the cooled liquids stream such that the cooled liquids stream is received by a cooled liquids inlet of the heat exchanger, wherein the heat exchanger is configured to form the finished fuel gas stream from the cooled fuel stream received by the fuel inlet of the heat exchanger, and to form the finished liquids stream from the cooled liquids stream received by the cooled liquids inlet of the heat exchanger. In certain embodiments, the gross ideal heating value of the finished fuel gas stream discharged from the heat exchanger is equal to or greater than 1,000 BTU/ft$^3$. In certain embodiments, the temperature of the raw feed stream received by the heat exchanger is less than 150 degrees Fahrenheit. In some embodiments, the fuel gas conditioning unit comprises a support structure upon which the heat exchanger, the expansion device, and the feed separator are physically supported. In some embodiments, the heat exchanger comprises a plurality of parting sheets defining a plurality of separate flow channels positioned between the plurality of parting sheets, a plurality of fin sheets positioned in the plurality of flow channels. In certain embodiments, the heat exchanger comprises a hot section defining a hot feed flowpath configured to receive the raw feed stream, a hot fuel flowpath configured to discharge the finished fuel gas stream, and a hot liquids flowpath configured to discharge the finished liquids stream, and wherein the hot section of the heat exchanger is configured to transfer heat in the hot section from the raw feed stream to both the finished fuel gas stream and the finished liquids stream, and a cold section separate from the hot section and defining a cold feed flowpath configured to discharge the cooled feed stream formed from the raw feed stream, a cold fuel flowpath configured to receive the cooled fuel stream, and a cold liquids flowpath configured to receive the cooled liquids stream, and wherein the cold section of the heat exchanger is configured to transfer heat in the cold section from the raw feed stream discharged from the hot section of the heat exchanger to both the finished fuel gas stream and the cooled liquids stream.

BRIEF DESCRIPTION OF THE DRAWINGS

For a detailed description of exemplary embodiments of the disclosure, reference will now be made to the accompanying drawings in which.

DETAILED DESCRIPTION OF THE DISCLOSED EMBODIMENTS

Figure 1:
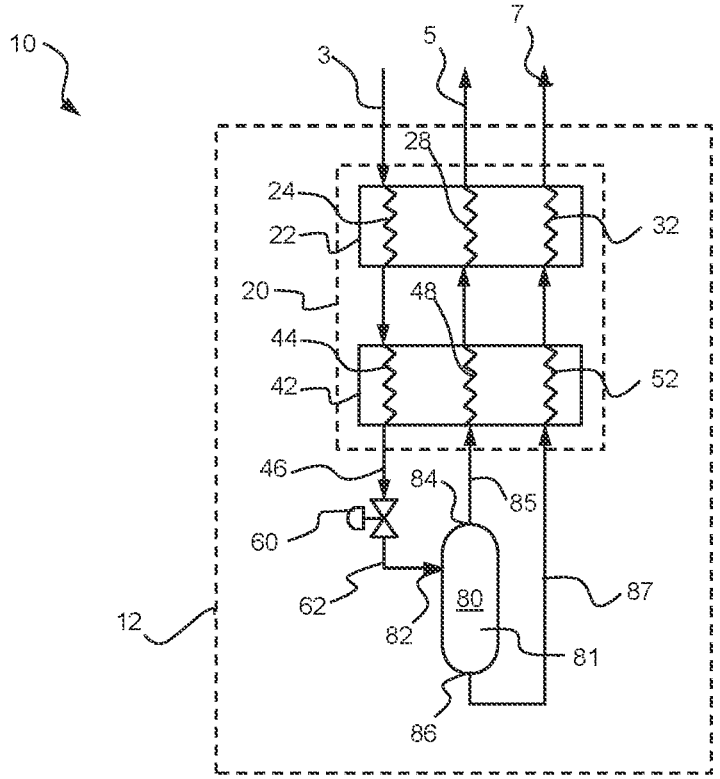
FIG. 1 is a schematic view of an embodiment of a fuel gas conditioning unit in accordance with principles described herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

As described above, natural gas systems include components which consume fuel gas as part of their normal operation, where such components include, among other things, natural gas engines of compressor packages used to transport natural gas from an upstream production area to a downstream location where the natural gas may be refined prior to being consumed by an end-user. The performance of fuel gas-consuming components such as natural gas engines may be contingent upon the quality of the fuel gas supplied to the fuel gas-consuming component. For example, fuel gas having a relatively high gross heating value, moisture content, comprising a relatively greater number of long-chain alkanes (e.g., C3+), and/or having a high degree of solid particles may reduce the performance of at least some fuel gas-consuming components, including the natural gas engines of compressor packages.

In order to maximize the performance of fuel gas-consuming components, including the natural gas engines of compressor packages, natural gas systems often include one or more fuel gas conditioning units that conditions a stream of raw feed gas (which may comprise natural gas) received by the fuel gas conditioning unit to produce a stream of fuel gas that may be consumed by one or more fuel gas-consuming components of the natural gas system. Finished fuel gas produced by fuel gas conditioning units may also be distributed via pipeline for sale and custody transfer. Specifically, fuel gas conditioning units typically include a Joule-Thomson (JT) or expansion valve which expands the stream of raw feed gas received by the fuel gas conditioning unit to allow for liquids and/or solids to be separated from the raw feed gas to thereby form the fuel gas produced by the fuel gas conditioning unit. Indeed, fuel gas conditioning units may also be referred to as JT units or JT skids.

In addition to a JT valve, fuel gas conditioning units typically include a heat exchanger for transferring heat from both the relatively hot raw feed gas and the finished fuel gas to the condensed liquids (e.g., natural gas liquids (NGL)) separated from the raw fuel gas by the fuel gas conditioning unit. Conventionally, the heat exchanger of fuel gas conditioning units include a pipe-in-pipe-in-pipe heat exchanger in which a central or inner pipe transports condensed liquids, a middle pipe which transports raw feed gas in a first or inner annulus formed between an inner surface of the middle pipe and an outer surface of the inner pipe, and an outer pipe which transports the finished fuel gas produced by the fuel gas conditioning unit.

Generally, the heat exchangers (e.g., pipe-in-pipe-in-pipe heat exchangers) utilized in conventional fuel gas conditioning units are relatively ineffective at transferring heat between the three separate streams (raw feed gas, finished fuel gas, and condensed liquids) received by the heat exchanger, requiring a relatively large temperature differential between the three streams to accomplish the desired degree of heat transfer between the three separate streams. Conventionally, the required temperature differential is accomplished through greater expansion of the raw feed gas through the JT valve, resulting in the production of a relatively lower pressure and colder expanded feed gas stream. However, increased expansion of the raw gas stream through the JT valve requires the raw feed gas received by the conventional fuel gas conditioning unit to have a relatively greater inlet or initial pressure. Further, the high pressure of the raw feed gas received by the conventional fuel gas conditioning unit limits the effectiveness of the fuel gas conditioning unit in separating out undesired liquids from the finished fuel gas due to the relative fugacities of the various components comprising the raw feed gas. Particularly, as the pressure of the raw feed gas increases, the difference between the relative fugacities of the components comprising the raw feed gas decrease. Additionally, with this decrease in relative fugacities of the components comprising the raw feed gas, preferential separation of the components of the raw feed gas into the gas and liquid phases decreases. The reduction in preferential separation of the components results in the condensing of excess lighter chemicals into the liquid phase which either are recycled through the condensed liquid stream or evaporate heavier components of the raw feed gas if eventually re-vaporized during the JT process.

Accordingly, embodiments of fuel gas conditioning units described herein include a brazed aluminum heat exchanger that maximizes heat transfer between a feed gas stream received by the heat exchanger, a fuel gas stream discharged from the heat exchanger, and a condensed liquids stream discharged from the heat exchanger. Particularly, the brazed aluminum heat exchanger defines a plurality of flow channels through which various streams, including the feed gas, fuel gas, and condensed liquids streams are conveyed. Each of the flow channels of the brazed aluminum heat exchanger receives a fin sheet defining a plurality of fins which maximize the surface area contacted by a given stream conveyed through the flow channel, in-turn maximizing heat transfer from a first stream conveyed through a first flow channel of the brazed aluminum heat exchanger to a second stream conveyed through a second flow channel of the brazed aluminum heat exchanger.

By maximizing the amount of heat transfer effected by the heat exchanger thereof, embodiments of fuel gas conditioning units described herein may utilize raw feed streams at a substantially lower pressure than compared to conventional fuel gas conditioning units, thereby maximizing the selectivity in consolidating desired components of the raw feed stream (e.g., methane and ethane components) into the finished fuel gas stream produced by the fuel gas conditioning unit. Additionally, embodiments of fuel gas conditioning units described herein may include an additional reboiler separator configured to extract additional light components (e.g., methane and ethane components) from a cooled liquids stream received by the heat exchanger of the fuel gas conditioning unit.

Referring now to FIG. 1, an embodiment of a fuel gas conditioning unit 10 is shown. In this exemplary embodiment, fuel gas conditioning unit 10 generally includes a support structure 12, a heat exchanger 20, an expansion device 60, and a feed separator 80. In this exemplary embodiment, the components of fuel gas conditioning unit 10 are physically supported on the support structure 12 thereof, including the heat exchanger 20, expansion device 60, and feed separator 80. However, it may be understood that in other embodiments the components of fuel gas conditioning unit 10 may not be supported on a single support structure like structure 12. For example, in some embodiments, the components of fuel gas conditioning unit 10 may be distributed across different locations that may be physically distant from each other. Additionally, the support structure 12 of fuel gas conditioning unit 10 may comprise a skid or other structure. In some embodiments, support structure 12 (and fuel gas conditioning unit 10 generally) may be road- or rail-transportable.

Figure 2:
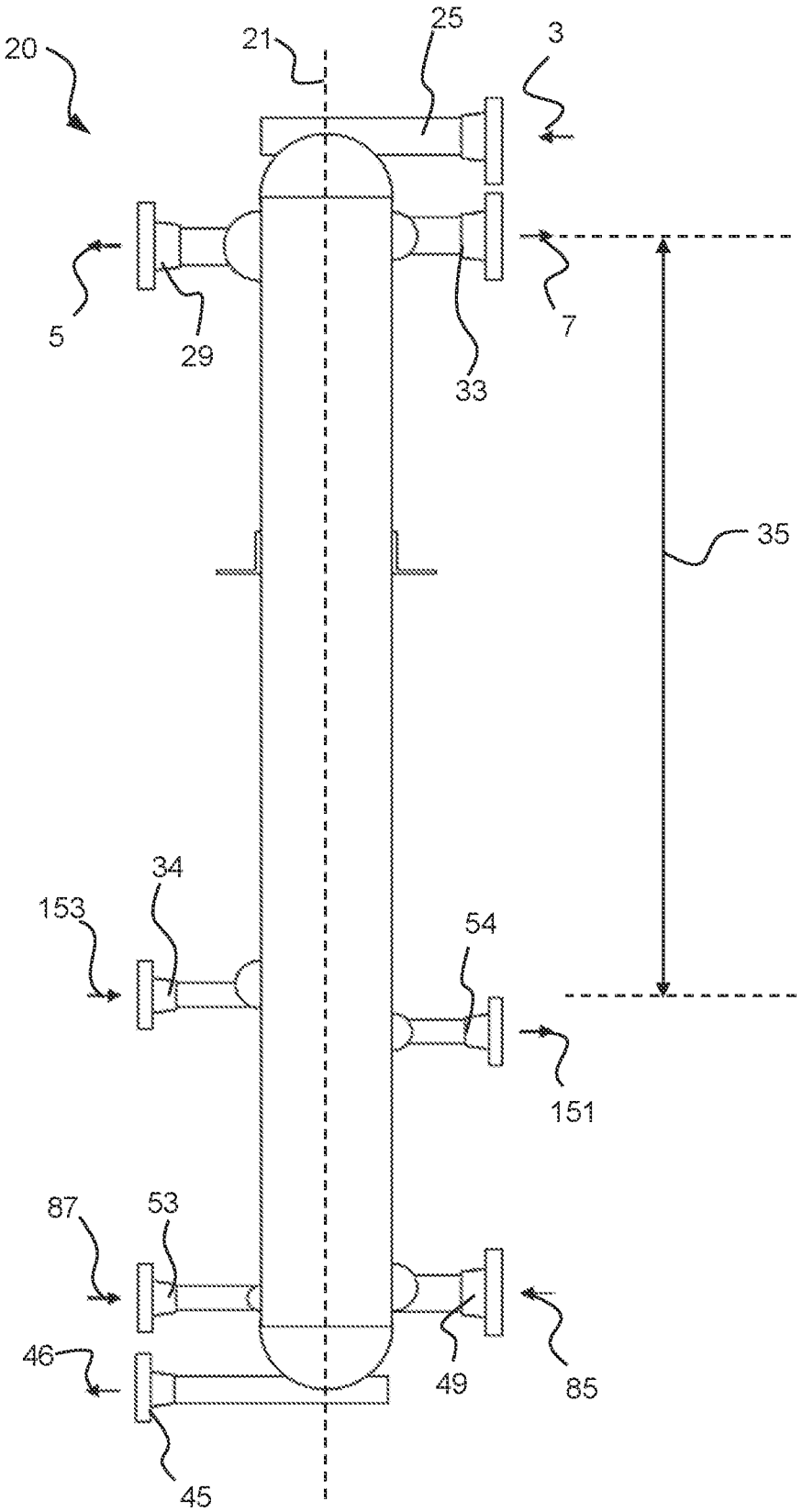
FIG. 2 is a side view of an embodiment of a heat exchanger of the fuel gas conditioning unit of FIG. 1.

Referring now to FIGS. 1 and 2, an additional view of the heat exchanger 20 is provided by FIG. 2. The heat exchanger 20 of fuel gas conditioning unit 10 is positioned on the support structure 12 in this exemplary embodiment and receives a gaseous raw feed stream 3 while discharging both a finished fuel gas stream 5 and a finished liquid stream 7. In this exemplary embodiment, heat exchanger 20 has a longitudinal axis 21 and includes a hot section or side 22 and a cold section or side 42 where heat transfer occurs across both the hot section 22 and the cold section 42. The hot section 22 and cold section 42 may occupy physically spaced sections of the heat exchanger 20 in some embodiments while in other embodiments the hot section 22 and cold section 42 may physically overlap across the heat exchanger 20.

In this exemplary embodiment, the hot section 22 of heat exchanger 20 defines a plurality of separate flowpaths 24, 28, 32 sealed from each other while accommodating heat transfer between each of the fluids conveyed through the separate flowpaths 24, 28, and 32 of hot section 22. For example, heat may be transferred from a fluid conveyed through a first flowpath 24 of the plurality of flowpaths 24, 28, and 32 to both a second flowpath 28 and a third flowpath 32 of the plurality of flowpaths 24, 28, and 32. In this exemplary embodiment, the cold section 42 of heat exchanger 20 similarly defines a plurality of separate flowpaths 44, 48, 52 sealed from each other while accommodating heat transfer between each of the fluids conveyed through the separate flowpaths 44, 48, and 52 of cold section 42. Additionally, in this exemplary embodiment, the hot section 22 comprises a plurality of hot inlets 25 and 34, and a plurality of hot outlets 29 and 33 while the cold section 42 comprises a plurality of cold inlets 49, 53 and a plurality of cold outlets 45, 54, as shown particularly in FIG. 2. As shown particularly in FIG. 2, outlet 33 is spaced from inlet 34 along the longitudinal axis 21 of heat exchanger 20 by a predefined distance 35. The longitudinal distance 35 may be expressed as a percentage of the longitudinal (e.g., along longitudinal axis 21) of heat exchanger 20. The longitudinal distance or spacing 35 between inlet 34 and outlet 33 may be tuned based on properties of the raw feed stream 3 and/or the condensed liquids stream 7. For example, the longitudinal distance 35 may be contingent on the gross ideal gas heating value of raw feed stream 3.

Particularly, in some embodiments, the longitudinal distance 35 may be correlated (e.g., negatively correlated) with the gross ideal heating value of raw feed stream 3. In some embodiments, for a raw feed stream 3 having a gross ideal heating value between approximately 1,325 BTU and 1,400 BTU, the longitudinal distance 35 is between approximately 75% and 50% of the longitudinal length of heat exchanger 20. In certain embodiments, for a raw feed stream 3 having a gross ideal heating value between approximately 1,250 BTU and 1,325 BTU, the longitudinal distance 35 is between approximately 85% and 65% of the longitudinal length of heat exchanger 20. In certain embodiments, for a raw feed stream 3 having a gross ideal heating value between approximately 1,150 BTU and 1,250 BTU, the longitudinal distance 35 is between approximately 95% and 75% of the longitudinal length of heat exchanger 20.

As an example, heat may be transferred from a fluid conveyed through a first flowpath 44 of the plurality of flowpaths 44, 48, and 52 to both a second flowpath 48 and a third flowpath 52 of the plurality of flowpaths 44, 48, and 52. While in this exemplary embodiment the hot section 22 and cold section 42 of heat exchanger 20 each define three separate flowpaths-flowpaths 24, 28, and 32 and flowpaths 44, 48, and 52, respectively—it may be understood that in other embodiments the hot section 22 and/or cold section 42 may include fewer than two separate flowpaths (each flowpath being sealed from each other) and more than three separate flowpaths. Additionally, in other embodiments, heat exchanger 20 may have only a single section (rather than the pair of sections 22 and 42 in this exemplary embodiment) or more than two sections.

In this exemplary embodiment, heat exchanger 20 comprises a brazed aluminum heat exchanger (BAHX) and thus may also be referred to herein as BAHX 20. Generally, brazed aluminum heat exchangers are a type of heat exchanger formed from sheets of aluminum which are separated by fins allowing for fluid flow between adjacent sheets and heat transfer through the fins and the adjacent sheets to secondary fluids flowing between other sheets of the BAHX. BAHXs are typically held together by brazing the fins to each sheet thereby providing the strength to withstand the internal pressure present within the BAHX during operation. Heat exchanger 20 is formed from aluminum and comprises a plurality of flow channels each defined by a sheet of corrugated fins joined between a pair of opposing parting sheets which it, along with side bars and/or cap sheets defining an exterior of the heat exchanger 20, seal the flow channel from similarly configured flow channels also defined by the heat exchanger 20 and positioned adjacent to the sealed flow channel.

Figure 3:
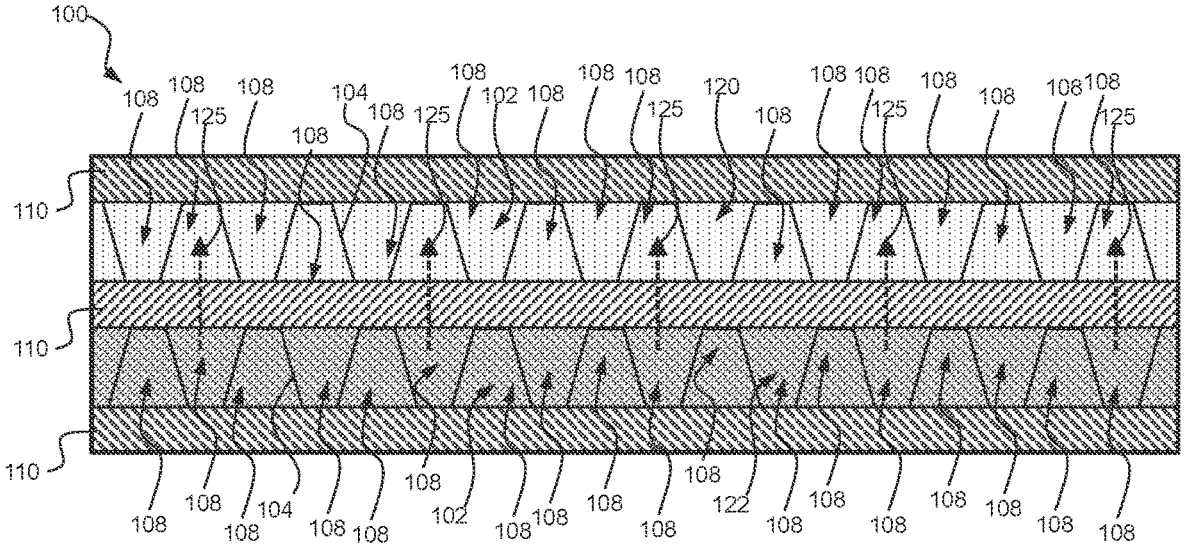
FIG. 3 is a partial cross-sectional view of an embodiment of a brazed aluminum heat exchanger.

Referring briefly to FIG. 3, to provide an example, an embodiment of a BAHX 100 is partially shown. BAHX 100 includes a plurality of separate flow channels 102 and a plurality of parting sheets 110 sandwiched between the flow channels 102 to seal the flow channels 102 from each other. Parting sheets 110 are relatively thin and planar in arrangement, providing flow channels 102 with a generally rectangular cross-section. Additionally, a fin sheet 104 is positioned in each flow channel 102, each fin sheet 104 defining a plurality of separate fins extending across the given flow channel 102. Each fin sheet 104 and parting sheet 110 is formed from aluminum, with the fin sheets 104 being brazed along opposing sides to a corresponding pair of fin sheets 110 to form a given flow channel 102 positioned therebetween. Fluid flowing through a given flow channel 102 contacts both the pair of parting sheets 110 defining the flow channel 102 and the fins of the fin sheet 104 positioned therein, maximizing the surface area contacted by the conveyed fluid and in-turn maximizing the surface area across which heat transfer may occur between the flow channels 102. Additionally, the fin sheet 104, being brazed to the pair of parting sheets 110, divide each flow channel 102 into a plurality of separate fluid conduits 108 spaced laterally across the flow channel 102 and sealed from each other.

In this configuration, a first fluid stream 120 may flow through a first flow channel 102 of heat exchanger 100 while a second fluid stream 122 flows through a second flow channel 102. Fluid streams 120 and 122 may comprise a liquid, a gas, or a multi-phase fluid. The first fluid stream 120 may flow in the same or a different direction through heat exchanger 100 as the second fluid stream 122. The first fluid stream 120 may be at a first temperature while the second fluid stream 122 may be at a second temperature that is greater than the first temperature whereby heat transfer (indicated schematically by arrows 125 in FIG. 3) occurs from the second fluid stream 122 to the first fluid stream 120 whereby the first fluid stream 120 is warmed as the second fluid stream 122 is cooled as the fluid streams 120 flow through the heat exchanger 100. Additionally, it may be understood that first fluid stream 120 and second fluid stream 122, along with other fluid streams, may each be conveyed through multiple flow passages or channels 102 in an alternating or sandwiched arrangement. As shown in FIG. 3, the surface area provided by fin sheets 104 and parting sheets 110 for accommodating heat transfer between the pair of fluid streams 120 and 122 is substantially larger than the heat transfer surface area provided by other heat exchangers including, for example, pipe-in-pipe heat exchangers. It may be understood that the larger heat transfer surface area provided by heat exchanger 100 allows heat exchanger 100 to transfer a greater amount of heat between the fluid streams 120 and 122 at a given inlet temperature differential for the pair of fluid streams 120 and 122. To state in other words, the initial or inlet temperature different of the fluid streams 120 and 122 as they enter heat exchanger 100 required to effect a given amount of heat transfer between the pair of fluid streams 120 and 122 in the heat exchanger 100 is minimized as a result of the large heat transfer surface area provided by heat exchanger 100.

Referring again to FIGS. 1 and 2, it may be understood that the flowpaths 24, 28, 32, 44, 48, and 52 defined by the heat exchanger 20 of fuel gas conditioning unit 10 may be configured similarly as the flow channels 102 of the heat exchanger 100 shown in FIG. 3. For example, each of the flowpaths 24, 28, 32, 44, 48, and 52 defined by the heat exchanger 20 may each comprise a plurality of separate flow channels configured similarly as the flow channels 102 of heat exchanger 100 in a sandwiched arrangement. As an example, the flowpaths 24, 28, and 32 associated with the hot section 22 of the heat exchanger 20 may each comprise a plurality of flow channels configured similarly as flow channels 102 that are sandwiched together in an alternating arrangement whereby heat transfer between fluids conveyed along flowpaths 24, 28, and 32 may be maximized.

As described above, in this exemplary embodiment, the heat exchanger 20 of fuel gas conditioning unit 10 receives the raw feed stream 3 which comprises natural gas. Raw feed stream 3 may be conveyed from another component of a natural gas system comprising the fuel gas conditioning unit 10, a gas pipeline, a wellhead, or another source. In some embodiments, methanol may be injected into the raw feed stream 3 before the stream 3 is received by the heat exchanger 20. In this exemplary embodiment, raw feed stream 3 received by heat exchanger 20 may be at a temperature between approximately 80 degrees Fahrenheit (° F.) and 120° F., and may be at a pressure that is between approximately 400 PSIG and 1,000 PSIG.

In this exemplary embodiment, the raw feed stream 3 enters the heat exchanger 20 via inlet 25 which may also be referred to herein as raw feed inlet 25. After entering heat exchanger 20, the raw feed stream 3 flows sequentially along flowpath 24 of hot section 22 and flowpath 44 of cold section 42 before exiting heat exchanger 20 via outlet 45 which may also be referred to herein as cold feed outlet 45. The raw feed gas exits cold feed outlet 45 as a cooled feed stream 46 having a temperature that is substantially less than the raw feed stream 3 received by the heat exchanger 20. In some embodiments, cooled feed stream 46 has a temperature between approximately 0° F. and −100° F. In certain embodiments, cooled feed stream 46 has a pressure between approximately 400 PSIG and 500 PSIG. Thus, the cooled feed stream 46 may have a low temperature but a high pressure and may be liquid in phase. In some embodiments, the temperature differential between the raw feed stream 3 and the cooled feed stream 46 is between approximately 100° F. and 150° F. Thus, heat exchanger 20 cools the raw feed stream 3 received thereby substantially therein.

In this exemplary embodiment, the cooled feed stream 46 flows from the heat exchanger 20 and into the expansion device 60 of fuel gas conditioning unit 10 where the cooled feed stream 46 is expanded to form an expanded feed stream 62 that is discharged from the expansion device 60. In some embodiments, methanol may be injected into the cooled feed stream 46 before the stream 46 is received by the expansion device 60. The expansion device 60 comprises an expansion valve such as a JT valve in this exemplary embodiment. However, it may be understood that expansion device 60 may comprise other types of expansion devices known in the art such as expanders, turbines, supersonic separators and the like.

In some embodiments, the expanded feed stream 62 has a temperature of between approximately −60° F. and −150° F., and a pressure of between approximately 50 PSIG and 150 PSIG. Thus, the expansion device 60 substantially reduces the pressure of the cooled feed stream 46 to form the expanded feed stream 62. In some embodiments, the expansion device 60 expands the cooled feed stream 46 from a pure liquid phase to a mixed- or two-phase when discharged as the expanded feed stream 62.

Following expansion in the expansion device 60, in this exemplary embodiment, the expanded feed stream 62 is conducted from the expansion device 60 to an inlet 82 of the feed separator 80. In this exemplary embodiment, feed separator 80 comprises a vertically oriented column or feed separator 80 and thus may also be with inlet 82 comprising a side inlet 82 positioned between a vertically upper end or top of the feed separator 80 and a vertically lower end or bottom of the feed separator 80. It may however be understood that the physical configuration and orientation of feed separator 80 may vary in other embodiments. In addition to the side inlet 82, in this exemplary embodiment, feed separator 80 comprises a first or overhead outlet 84 located at or around the top of feed separator 80 and vertically above the side inlet 82, and a second or bottom outlet 86 located at or around the bottom of feed separator 80 and vertically below the side inlet 82.

In this exemplary embodiment, feed separator 80 receives the expanded feed stream 62 via the side inlet 82 which is separated within an internal volume 81 of the feed separator 80 into a gaseous cooled fuel stream 85 that is discharged from the overhead outlet 84 of feed separator 80 and a bottoms cooled liquids stream 87 that is discharged from the bottom outlet 86 of feed separator 80. In some embodiments, the cooled fuel stream 85 has a methane (C1) mole fraction of approximately 90% or more while the bottoms Cooled liquids stream 87 has a methane mole fraction that is approximately 15% or less. Briefly, carbon compounds may be referred to herein both by their given name (e.g., methane, ethane) and by their root name (C1, C2, C3, C4). Additionally, in this exemplary embodiment, the mole fraction of carbon compounds that are C2 or heavier (e.g., C3, C4) of cooled fuel stream 85 is approximately 10% or less while the mole fraction of C2 and heavier carbon compounds of the bottoms Cooled liquids stream 87 is approximately 50% or greater. Further, the mole fraction of carbon compounds that are C3 or heavier of cooled fuel stream 85 is approximately less than 1% while the mole fraction of C3 and heavier carbon compounds of the bottoms cooled liquids stream 87 is approximately 30% or greater.

Moreover, it may be understood that the fuel gas conditioning unit 10 described herein minimizes the amount of methane dissolved in the condensed liquids stream 7 is appreciably lower than compared to the condensed liquids streams of conventional fuel gas conditioning units, thereby minimizing the requirements associated with the downstream processing of the condensed liquids stream 7. For example, in some embodiments, condensed liquids stream 7 of fuel gas conditioning unit 10 is less than 20% Methane by mole. In some embodiments, condensed liquids stream 7 is less than 15% Methane by mole. In certain embodiments, condensed liquids stream 7 is less than 10% Methane by mole. This may be compared with conventional fuel gas conditioning units having a condensed liquids stream that may be 30% Methane or greater (e.g., 50%) by mole.

Following separation within the feed separator 80, in this exemplary embodiment, the cooled fuel stream 85 and the bottoms Cooled liquids stream 87 are each separately conveyed from the feed separator 80 to the cold section 42 of the heat exchanger 20. Particularly, the cooled fuel stream 85 is received by the inlet 49 of heat exchanger 20 which may also be referred to herein as cold fuel inlet 49 while the bottoms Cooled liquids stream 87 is received by inlet 53 of heat exchanger 20 which may also be referred to herein as bottoms NGL inlet 53. In some embodiments, the cooled fuel stream 85 has a temperature between approximately −150° F. and −100° F. and a pressure between approximately 50 PSIG and 150 PSIG.

Having been received by heat exchanger 20, cooled fuel stream 85 flows sequentially along flowpath 48 of the cold section 42 and flowpath 28 of the hot section 22 of heat exchanger 20 before being discharged from heat exchanger 20 as finished fuel gas stream 5. Particularly, finished fuel gas stream 5 is discharged from outlet 29 of heat exchanger 20 which also may be referred to herein as fuel gas outlet 29. In some embodiments, the finished fuel gas stream 5 has a calculated gross ideal gas heating value of between approximately 1,000 BTU/ft$^3$ and 1,100 BTU/ft$^3$. Additionally, in some embodiments, the finished fuel gas stream 5 has a temperature between approximately 10° F. and 80° F. and a pressure between approximately 50 PSIG and 150 PSIG. In certain embodiments, the temperature differential between the cooled fuel stream 85 and the finished fuel gas stream 5 is between approximately 100° F. and 200° F.

In this exemplary embodiment, the bottoms Cooled liquids stream 87 flows sequentially along flowpath 52 of the cold section 42 and flowpath 32 of the hot section 22 of heat exchanger 20 before being discharged from heat exchanger 20 as finished liquid stream 7. Particularly, finished liquid stream 7 is discharged from outlet 33 of heat exchanger 20 which also may be referred to herein as finished liquids outlet 33. The condensed liquid stream 7 may be recycled by another component of the natural gas system comprising fuel gas conditioning unit 10. As but one example, the condensed liquid stream 7 may be recycled into a gas stream of the natural gas system where the recycled condensed liquid stream 7 may be evaporated by the gas stream and subsequently transported to a downstream processing facility where the evaporated stream may be subjected to secondary stabilization prior to being stored in a tank and sold as NGL. In some embodiments, the finished liquid stream 7 has a temperature between approximately 30° F. and 100° F. and a pressure between approximately 50 PSIG and 150 PSIG. Additionally, in certain embodiments, the mole fraction of C2 and C3 carbon compounds of finished liquid stream 7 is over 50% while the mole fraction of C1 carbon compounds is less than 20%. In certain embodiments, the mole fraction of C4 and heavier carbon compounds (e.g., C5, C6) of the condensed liquid stream 7 is 15% or greater. Further, while in this exemplary embodiment, the condensed liquid stream flows directly between the flowpath 52 of the cold section 42 of heat exchanger 20 to the flowpath 32 of the hot section 22 thereof, in other embodiments the condensed liquid stream may exit the heat exchanger 20 after flowing along flowpath 52 and before being received by the hot section 22 of heat exchanger 20.

In some embodiments, the temperature differential between the raw feed gas stream 3 and the finished fuel gas stream 5 is less than approximately 100° F. In some embodiments, the temperature differential between the raw feed gas stream 3 and the finished fuel gas stream 5 is less than approximately 75° F. In certain embodiments, the temperature differential between the raw feed gas stream 3 and the finished fuel gas stream 5 is less than approximately 50° F. Additionally, in certain embodiments, the temperature differential between the raw feed gas stream 3 and the finished liquid stream 7 is less than approximately 75° F. In some embodiments, the temperature differential between the raw feed gas stream 3 and the finished liquid stream 7 is less than approximately 50° F. In some embodiments, the temperature differential between the raw feed gas stream 3 and the finished liquid stream 7 is less than approximately 25° F. In this manner, the temperature differential between the different streams entering the hot side 22 of the heat exchanger 20 may be relatively less than the temperature differential of the streams received by the conventional heat exchanger of conventional fuel gas conditioning units.

In certain embodiments, the pressure differential between the raw feed gas stream 3 and the finished fuel gas stream 5 is less than approximately 1,000 PSIG. In certain embodiments, the pressure differential between the raw feed gas stream 3 and the finished fuel gas stream 5 is less than approximately 800 PSIG. In some embodiments, the pressure differential between the raw feed gas stream 3 and the finished fuel gas stream 5 is less than approximately 600 PSIG. In some embodiments, the pressure differential between the raw feed gas stream 3 and the finished fuel gas stream 5 is less than approximately 500 PSIG. In certain embodiments, the pressure differential between the raw feed gas stream 3 and the finished fuel gas stream 5 is less than approximately 450 PSIG. In certain embodiments, the pressure differential may correspond to the lowest pressure necessary to achieve the desired gross heating value for the finished fuel gas.

Additionally, in certain embodiments, the pressure differential between the raw feed gas stream 3 and the finished liquid stream 7 is less than approximately 600 PSIG. In some embodiments, the pressure differential between the raw feed gas stream 3 and the finished liquid stream 7 is less than approximately 500 PSIG. In some embodiments, the pressure differential between the raw feed gas stream 3 and the finished liquid stream 7 is less than approximately 450 PSIG. As with the reduced temperature differential noted above, the pressure differential between the different streams entering the hot side 22 of the heat exchanger 20 may be relatively less than the pressure differential of the streams received by the conventional heat exchanger of conventional fuel gas conditioning units.

The reduced temperature and pressure differential between the different streams received by the heat exchanger 20 relative to conventional fuel gas conditioning units permits the fuel gas conditioning unit 10 a greater degree of selectivity in separating the various carbon compounds comprising the raw feed stream 3 when forming the finished fuel gas stream 5 and the finished liquids stream 7. Specifically, a greater amount of fuel gas may be obtained from a given amount of raw feed gas relative to conventional fuel gas conditioning units such that the ratio of fuel gas to liquids produced from a given amount of raw feed gas is greater for the embodiments of fuel gas conditioning units disclosed herein relative to conventional fuel gas conditioning units. Additionally, it may be understood that condensed liquids act to decrease the efficiency of a fuel gas conditioning unit given that the condensed liquids must typically either be recycled through a compression process or stabilized as part of a stabilization process where both the compression and stabilization processes require additional energy from the fuel gas conditioning unit. Thus, by minimizing the amount of condensed liquids produced from a given amount of raw feed gas, the efficiency of the embodiments of fuel gas conditioning units disclosed herein is maximized.

Figure 4:
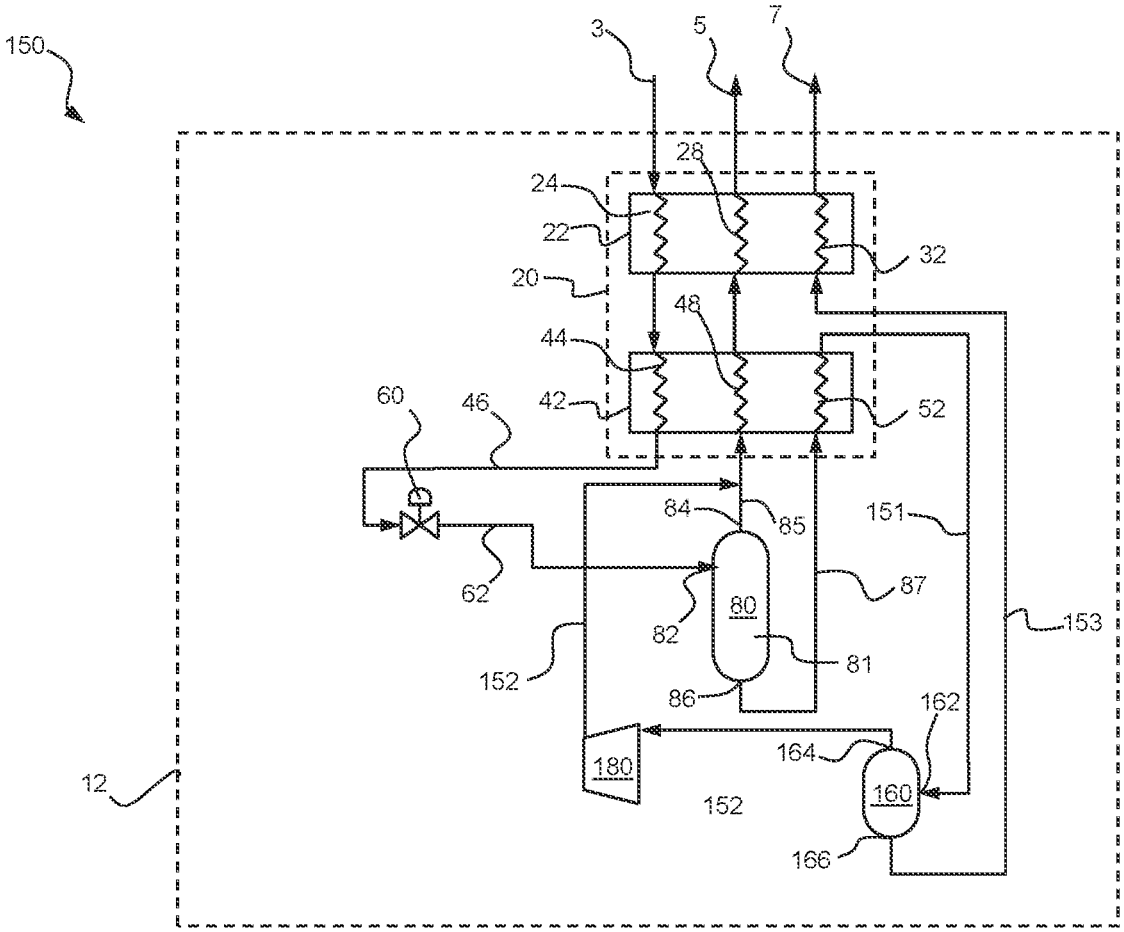
FIG. 4 is a schematic view of another embodiment of a fuel gas conditioning unit in accordance with principles described herein.

Referring now to FIG. 4, another embodiment of a fuel gas conditioning unit 150 is shown. Fuel gas conditioning unit 150 may include features in common with the fuel gas conditioning unit 10 shown in FIG. 1, and shared features are labeled similarly. Particularly, in this exemplary embodiment, fuel gas conditioning unit 150 generally includes support structure 12, heat exchanger 20, expansion device 60, and feed separator 80, a reboiler separator 160, and a gas circulator 180.

In this exemplary embodiment, the cooled liquids stream 87 received by the cold section 42 of heat exchanger 20 is warmed as it is conveyed along flowpath 52 and is discharged from the heat exchanger 20 via the outlet 54 thereof as a mixed- or two-phase reboiler stream 151, where outlet 54 of heat exchanger 20 may also be referred to herein as reboiler outlet 54. In some embodiments, the reboiler stream 151 is at a temperature between approximately −150° F. and −50° F. and has a pressure that is between approximately 50 PSIG and 150 PSIG. In certain embodiments, the reboiler stream 151 is at a temperature between approximately −120° F. and −80° F. and has a pressure that is between approximately 80 PSIG and 120 PSIG.

The reboiler stream 151 discharged from the cold section 42 of heat exchanger 20 is received by an inlet 162 of the reboiler separator 160. The reboiler separator 160 may be vertically or horizontally oriented and in some embodiments may comprise a knockout drum or similar device. In addition to inlet 162, reboiler separator 160 comprises a first or overhead outlet 164 located at or near a vertically upper end or top of the reboiler separator 160, and a second or bottoms outlet 166 located at a vertically lower end or bottom of the reboiler separator 160. Reboiler separator 160 separates the reboiler stream 151 within an interior 161 of the separator 160 into a gaseous recycle stream 152 that is discharged through the overhead outlet 164, and a condensed liquids stream 153 that is discharged through the bottoms outlet 166 of reboiler separator 160.

The recycle stream 152, in this exemplary embodiment, is circulated by the gas circulator 180 of fuel gas conditioning unit 150 from the overhead outlet 164 of reboiler separator 160 to a location where the recycle stream 152 joins or is added to the cooled fuel stream 85 circulated from the feed separator 80 to the cold section 42 of the heat exchanger 20. In this exemplary embodiment, gas circulator 180 comprises a compressor; however, it may be understood that in other embodiments the configuration of gas circulator 180 may vary. In this manner, remaining light components (e.g., methane) entrained in the reboiler stream 151 may be separated therefrom and recycled as recycle stream 152 to the cooled fuel stream 85 which is eventually formed by heat exchanger 20 into the finished fuel gas stream 5, increasing the efficiency of fuel gas conditioning unit 10 in consolidating the C1 content of raw feed stream 3 received by unit 10 into the finished fuel gas stream 5 produced by unit 10. In some embodiments, the recycle stream 152 comprises methane at a mole fraction of the recycle stream 152 that is equal to or greater than 50%. In some embodiments, the recycle stream 152 comprises methane at a mole fraction of the recycle stream 152 that is equal to or greater than 75%. In some embodiments, the recycle stream 152 cumulatively comprises methane and ethane at a mole fraction of the recycle stream 152 that is equal to or greater than 75%. In certain embodiments, the recycle stream 152 cumulatively comprises methane and ethane at a mole fraction of the recycle stream 152 that is equal to or greater than 90%.

In this exemplary embodiment, the condensed liquids stream 153 circulates from the bottom outlet 166 of reboiler separator 160 to the inlet 34 of the hot section 22 of heat exchanger 20, where inlet 34 may be referred to as the cooled liquids inlet 34 of heat exchanger 20. In some embodiments, the condensed liquid stream 153 is at a temperature between approximately −120° F. and −80° F. and has a pressure that is between approximately 50 PSIG and 100 PSIG.

While embodiments of the disclosure have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A fuel gas conditioning unit, comprising:

a brazed aluminum heat exchanger comprising a plurality of parting sheets defining a plurality of separate flow channels positioned between the plurality of parting sheets, a plurality of fin sheets positioned in the plurality of flow channels, a hot section, a separate cold section, a feed inlet of the hot section configured to receive a raw feed stream, a cooled liquids inlet of the cold section configured to receive a cooled liquids stream, a cold fuel inlet of the cold section configured to receive a cooled fuel stream, a cooled feed outlet of the cold section configured to discharge a cooled feed stream formed from the raw feed stream, a fuel outlet configured to discharge a finished fuel gas stream, and a liquids outlet configured to discharge a finished liquids stream;

an expansion valve coupled to the heat exchanger and configured to receive the cooled feed stream from the heat exchanger and discharge an expanded feed stream formed from the cooled feed stream; and a feed separator, comprising:

an inlet coupled to the expansion valve and configured to receive the expanded feed stream;

an interior configured to separate the expanded feed stream into the cooled fuel stream and the cooled liquids stream;

a fuel outlet configured to discharge the cooled fuel stream such that the cooled fuel stream is received by a hot fuel inlet of the heat exchanger; and a cooled liquids outlet configured to discharge the cooled liquids stream such that the cooled liquids stream is received by the cooled liquids inlet of the heat exchanger;

wherein the heat exchanger is configured to transfer heat between the raw feed stream and both the cooled liquids stream and the cooled fuel stream across the hot section and the cold section of the heat exchanger, to form the finished fuel gas stream from the cooled fuel stream received by the hot fuel inlet of the heat exchanger, and to form the finished liquids stream from the cooled liquids stream received by the cooled liquids inlet of the heat exchanger.

2. The fuel gas conditioning unit of claim 1, further comprising a support structure upon which the heat exchanger, the expansion valve, and the feed separator are physically supported.

3. The fuel gas conditioning unit of claim 2, wherein the support structure comprises a road-transportable skid.

4. The fuel gas conditioning unit of claim 1, wherein the expansion valve comprises a Joule-Thomson (JT) valve.

5. The fuel gas conditioning unit of claim 1, wherein the pressure of the raw feed stream received by the heat exchanger is less than 1,000 pounds per square inch gauge (PSIG).

6. The fuel gas conditioning unit of claim 1, wherein the pressure of the raw feed stream received by the heat exchanger is less than 800 pounds per square inch gauge (PSIG).

7. The fuel gas conditioning unit of claim 1, wherein the pressure of the raw feed stream received by the heat exchanger is less than 600 pounds per square inch gauge (PSIG).

8. The fuel gas conditioning unit of claim 1, wherein the gross ideal heating value of the finished fuel gas stream discharged from the heat exchanger is equal to or greater than 1,150 British Thermal Units per foot cubed (BTU/$ft^3$).

9. The fuel gas conditioning unit of claim 1, wherein:

the hot section of the heat exchanger defines a hot feed flowpath configured to receive the raw feed stream, a hot fuel flowpath configured to discharge the finished fuel gas stream, and a hot liquids flowpath configured to discharge the finished liquids stream, and wherein the hot section of the heat exchanger is configured to transfer heat in the hot section from the raw feed stream to both the finished fuel gas stream and the finished liquids stream; and the cold section of the heat exchanger defines a cold feed flowpath configured to discharge the cooled feed stream formed from the raw feed stream, a cold fuel flowpath configured to receive the cooled fuel stream, and a cold liquids flowpath configured to receive the cooled liquids stream, and wherein the cold section of the heat exchanger is configured to transfer heat in the cold section from the raw feed stream discharged from the hot section of the heat exchanger to both the finished fuel gas stream and the cooled liquids stream.

10. The fuel gas conditioning unit of claim 9, further comprising:

a reboiler separator, comprising:

an inlet coupled to the cold section of the heat exchanger and configured to receive a reboil stream from a reboil outlet of the heat exchanger, wherein the reboil stream is formed in the cold section from the cooled liquids stream;

an overhead outlet configured to discharge a recycle stream formed from the reboil stream in the reboiler separator; and a bottoms outlet configured to discharge a condensed liquids stream separated from the reboil stream in the reboiler separator such that the condensed liquids stream is received by a liquids inlet of the hot section of the heat exchanger, wherein the hot section is configured to form the finished liquids stream from the condensed liquids stream.

11. The fuel gas conditioning unit of claim 10, wherein a longitudinal distance extending between the liquids inlet of the hot section of the heat exchanger and the fuel outlet of the heat exchanger is predefined based on a gross ideal heating value of the raw feed stream.

12. The fuel gas conditioning unit of claim 11, wherein the longitudinal distance is positively correlated with the gross ideal heating value of the raw feed stream.

13. The fuel gas conditioning unit of claim 11, wherein the gross ideal heating value of the raw feed stream is between 1,325 BTU and 1,400 BTU and the longitudinal distance is between 75% and 50% of a longitudinal length of the heat exchanger.

14. The fuel gas conditioning unit of claim 11, wherein the gross ideal heating value of the raw feed stream is between 1,250 BTU and 1,325 BTU and the longitudinal distance is between 85% and 65% of a longitudinal length of the heat exchanger.

15. The fuel gas conditioning unit of claim 11, wherein the gross ideal heating value of the raw feed stream is between 1,150 BTU and 1,250 BTU and the longitudinal distance is between 95% and 75% of a longitudinal length of the heat exchanger.

16. A fuel gas conditioning unit, comprising:

a heat exchanger comprising:

a hot section defining a hot feed flowpath configured to receive a raw feed stream, a hot fuel flowpath configured to discharge a finished fuel gas stream, and a hot liquids flowpath configured to discharge a finished liquids stream, and wherein the hot section of the heat exchanger is configured to transfer heat in the hot section from the raw feed stream to both a cooled fuel stream to form the finished fuel gas stream and a cooled liquids stream to form the finished liquids stream;

a cold section separate from the hot section and defining a cold feed flowpath configured to discharge a cooled feed stream formed from the raw feed stream, a cold fuel flowpath configured to receive the cooled fuel stream, and a cold liquids flowpath configured to receive the cooled liquids stream, and wherein the cold section of the heat exchanger is configured to transfer heat in the cold section from the raw feed stream discharged from the hot section of the heat exchanger to both the cooled fuel stream and the cooled liquids stream to form a cooled feed stream;

an expansion valve coupled to the heat exchanger and configured to receive the cooled feed stream from the heat exchanger and discharge an expanded feed stream formed from the cooled fuel stream;

a feed separator, comprising:

an inlet coupled to the expansion valve the and configured to receive the expanded feed stream;

a fuel outlet configured to discharge the cooled fuel stream that is separated from the expanded feed stream in the feed separator such that the cooled fuel stream is received by a fuel inlet of the heat exchanger; and a cooled liquids outlet configured to discharge a cooled liquids stream separated from the expanded feed stream in the feed separator such that the cooled liquids stream is received by a cooled liquids inlet of the heat exchanger.

17. The fuel gas conditioning unit of claim 16, wherein a longitudinal distance extending between the liquids inlet of the hot section of the heat exchanger and the fuel outlet of the heat exchanger is predefined based on a gross ideal heating value of the raw feed stream.

18. The fuel gas conditioning unit of claim 16, wherein the longitudinal distance is negatively correlated with the gross ideal heating value of the raw feed stream.

19. The fuel gas conditioning unit of claim 16, further comprising:

a reboiler separator, comprising:

an inlet coupled to the cold section of the heat exchanger and configured to receive a reboil stream from a reboil outlet of the heat exchanger, wherein the reboil stream is formed in the cold section from the cooled liquids stream;

an overhead outlet configured to discharge a recycle stream formed from the reboil stream in the reboiler separator; and a bottoms outlet configured to discharge a condensed liquids stream separated from the reboil stream in the reboiler separator such that the condensed liquids stream is received by a liquids inlet of the hot section of the heat exchanger, wherein the hot section is configured to form the finished liquids stream from the condensed liquids stream.

20. The fuel gas conditioning unit of claim 19, further comprising a gas circulator coupled to the reboiler separator and configured to circulate the recycle stream from the reboiler separator such that the recycle stream is added to the cooled fuel stream discharged from the feed separator.

21. The fuel gas conditioning unit of claim 19, wherein the recycle stream comprises methane at a mole fraction of the recycle stream that is equal to or greater than 50%.

22. The fuel gas conditioning unit of claim 19, wherein the recycle stream cumulatively comprises methane and ethane at a combined mole fraction of the recycle stream that is equal to or greater than 80%.

23. The fuel gas conditioning unit of claim 16, wherein the heat exchanger comprises a plurality of parting sheets defining a plurality of separate flow channels positioned between the plurality of parting sheets, a plurality of fin sheets positioned in the plurality of flow channels.

24. A fuel gas conditioning unit, comprising:

a brazed aluminum heat exchanger comprising a hot section, a separate cold section, a feed inlet of the hot section configured to receive a raw feed stream having a pressure that is less than 1,000 pounds per square inch gauge (PSIG), a cooled liquids inlet of the cold section configured to receive a cooled liquids stream, a cold fuel inlet of the cold section configured to receive a cooled fuel stream, a cooled feed outlet configured to discharge a cooled feed stream formed from the raw feed stream, a fuel outlet configured to discharge a finished fuel gas stream, and a liquids outlet configured to discharge a finished liquids stream;

an expansion valve coupled to the heat exchanger and configured to receive the cooled feed stream from the heat exchanger and discharge an expanded feed stream formed from the cooled feed stream; and a feed separator comprising an inlet coupled to the expansion valve and configured to receive the expanded feed stream, an interior configured to separate the expanded feed stream into the cooled fuel stream and the cooled liquids stream, a fuel outlet configured to discharge the cooled fuel stream such that the cooled fuel stream is received by a hot fuel inlet of the heat exchanger, and a cooled liquids outlet configured to discharge the cooled liquids stream such that the cooled liquids stream is received by a cooled liquids inlet of the heat exchanger;

wherein the heat exchanger is configured to transfer heat between the raw feed stream and both the cooled liquids stream and the cooled fuel stream across the hot section and the cold section of the heat exchanger, to form the finished fuel gas stream from the cooled fuel stream received by the hot fuel inlet of the heat exchanger, and to form the finished liquids stream from the cooled liquids stream received by the cooled liquids inlet of the heat exchanger.

25. The fuel gas conditioning unit of claim 24, wherein the gross ideal heating value of the finished fuel gas stream discharged from the heat exchanger is equal to or greater than 1,100 British Thermal Units per foot cubed ($BTU/ft^3$).

26. The fuel gas conditioning unit of claim 24, wherein the gross ideal heating value of the finished fuel gas stream discharged from the heat exchanger is equal to or greater than 1,050 British Thermal Units per foot cubed ($BTU/ft^3$).

27. The fuel gas conditioning unit of claim 24, wherein the temperature of the raw feed stream received by the heat exchanger is less than 150 degrees Fahrenheit.

28. The fuel gas conditioning unit of claim 24, further comprising a support structure upon which the heat exchanger, the expansion valve, and the feed separator are physically supported.

29. The fuel gas conditioning unit of claim 24, wherein the heat exchanger comprises a plurality of parting sheets defining a plurality of separate flow channels positioned between the plurality of parting sheets, a plurality of fin sheets positioned in the plurality of flow channels.

30. The fuel gas conditioning unit of claim 24, wherein the heat exchanger comprises:

a hot section defining a hot feed flowpath configured to receive the raw feed stream, a hot fuel flowpath configured to discharge the finished fuel gas stream, and a hot liquids flowpath configured to discharge the finished liquids stream, and wherein the hot section of the heat exchanger is configured to transfer heat in the hot section from the raw feed stream to both the finished fuel gas stream and the finished liquids stream; and a cold section separate from the hot section and defining a cold feed flowpath configured to discharge the cooled feed stream formed from the raw feed stream, a cold fuel flowpath configured to receive the cooled fuel stream, and a cold liquids flowpath configured to receive the cooled liquids stream, and wherein the cold section of the heat exchanger is configured to transfer heat in the cold section from the raw feed stream discharged from the hot section of the heat exchanger to both the finished fuel gas stream and the cooled liquids stream.

* * * * *